US011421686B2

(12) United States Patent
Shimozono et al.

(10) Patent No.: US 11,421,686 B2
(45) Date of Patent: Aug. 23, 2022

(54) COMPRESSOR FOR REFRIGERATING MACHINE

(71) Applicant: DAIKIN INDUSTRIES, LTD., Osaka (JP)

(72) Inventors: Naoki Shimozono, Osaka (JP); Mikio Kajiwara, Osaka (JP); Tomomi Yokoyama, Osaka (JP); Kouji Kojima, Osaka (JP); Tsuyoshi Fukunaga, Osaka (JP); Mahoba Ogawa, Osaka (JP); Yasuhiro Yamamoto, Osaka (JP)

(73) Assignee: Daikin Industries, Ltd., Osaka (JP)

( * ) Notice: Subject to any disclaimer, the term of this patent is extended or adjusted under 35 U.S.C. 154(b) by 705 days.

(21) Appl. No.: 16/321,443

(22) PCT Filed: Jul. 26, 2017

(86) PCT No.: PCT/JP2017/027118
§ 371 (c)(1),
(2) Date: Jan. 28, 2019

(87) PCT Pub. No.: WO2018/021442
PCT Pub. Date: Feb. 1, 2018

(65) Prior Publication Data

US 2021/0332818 A1 Oct. 28, 2021

(30) Foreign Application Priority Data

Jul. 29, 2016 (JP) ..... JP2016-150616

(51) Int. Cl.
*F04C 18/02* (2006.01)
*F04C 25/00* (2006.01)
(Continued)

(52) U.S. Cl.
CPC ..... *F04C 18/0215* (2013.01); *F04C 25/00* (2013.01); *F04C 2230/91* (2013.01); *F04C 2240/30* (2013.01); *F04C 2280/04* (2013.01)

(58) Field of Classification Search
CPC ..... F04C 18/0215; F04C 25/00; F04C 27/00; F04C 27/02; F04B 39/121; C23C 28/00; C23C 28/02; C23C 28/023
See application file for complete search history.

(56) References Cited

U.S. PATENT DOCUMENTS 4,575,322 A * 3/1986 Paquet ..... F04C 27/02 418/96
4,889,471 A 12/1989 Izunaga et al.
(Continued)

FOREIGN PATENT DOCUMENTS

EP 1 679 388 A1 7/2006
EP 3 045 844 A1 7/2016
(Continued)

OTHER PUBLICATIONS

European Search Report of corresponding EP Application No. 17 83 4444.6 dated Jun. 26, 2019.
(Continued)

*Primary Examiner* — Deming Wan
(74) *Attorney, Agent, or Firm* — Global IP Counselors, LLP

(57) ABSTRACT

A compressor includes a casing, a compression mechanism, and a motor that drives the compression mechanism. The casing is configured to cover an internal space. The internal space includes a first space and a second space larger than the first space. The casing has a first casing part covering the first space and a second casing part covering the second space. At least one of the first space and the second space is a high-pressure space configured to contain high-pressure fluid. A metallic coating may be formed on an outer surface
(Continued)

of at least the first casing part. Alternatively, a resin coating may be formed on an outer surface of the casing.

13 Claims, 7 Drawing Sheets

(51) Int. Cl.

| | |
|---|---|
| ***F04B 39/12*** | (2006.01) |
| ***F04C 27/00*** | (2006.01) |
| ***F04C 27/02*** | (2006.01) |

(56) References Cited

U.S. PATENT DOCUMENTS

| | | | | |
|---|---|---|---|---|
| 9,581,042 | B2 * | 2/2017 | Strock | C23C 30/00 |
| 9,850,899 | B2 * | 12/2017 | Chang | F04C 15/0061 417/410.1 |
| 11,125,231 | B2 * | 9/2021 | Shimozono | F04C 23/008 |
| 2003/0194576 | A1 | 10/2003 | Cooper et al. | |
| 2004/0175594 | A1 | 9/2004 | Cooper et al. | |
| 2006/0257272 | A1 | 11/2006 | Hori et al. | |
| 2010/0319372 | A1 * | 12/2010 | Lifson | F25B 49/022 62/115 |

FOREIGN PATENT DOCUMENTS

| | | | |
|---|---|---|---|
| JP | 58-160587 | A | 9/1983 |
| JP | 2000-130370 | A | 5/2000 |
| JP | 2002-303272 | A | 10/2002 |
| JP | 2003-278656 | A | 10/2003 |
| JP | 2005-2799 | A | 1/2005 |
| JP | 2010-127272 | A | 6/2010 |
| TW | 201518171 | | 5/2015 |
| WO | 2012/086244 | A1 | 6/2012 |

OTHER PUBLICATIONS

International Search Report of corresponding PCT Application No. PCT/JP2017/027118 dated Oct. 17, 2017.
International Preliminary Report of corresponding PCT Application No. PCT/JP2017/027118 dated Feb. 7, 2019.

* cited by examiner

COMPRESSOR FOR REFRIGERATING MACHINE

CROSS-REFERENCE TO RELATED APPLICATIONS

This U.S. National stage application claims priority under 35 U.S.C. § 119(a) to Japanese Patent Application No. 2016-150616, filed in Japan on Jul. 29, 2016, the entire contents of which are hereby incorporated herein by reference.

TECHNICAL FIELD

The present invention relates to a compressor for a refrigerating machine.

BACKGROUND ART

Refrigerating machines are devices for controlling the target temperature, among which are included a wide range of machines such as freezers, refrigerators, air conditioners, ocean shipping containers, water heaters, and radiators. A refrigerating machine includes a refrigerant circuit in which a compressor for compressing the refrigerant is installed. Japanese Patent Application Laid-open Publication No. 2002-303272 discloses a compressor used in an ocean shipping container.

Compressors used for ocean shipping are required to have high durability. Motors, in particular, which are required to meet stringent durability requirements, are often disposed in a space in the casing that is filled with a low-temperature, low-pressure gas refrigerant, so as to be cooled when generating heat. For this reason, the compressors adopt a so-called low-pressure dome structure in which the low-pressure gas refrigerant is contained in most of the internal space of the casing.

SUMMARY

During operation of one such compressor, dew condensation occurs on the outer surface of the region of the casing that covers the space containing the low-temperature, low-pressure gas refrigerant. The condensed moisture freezes. The ice on the outer surface of the casing melts after the operation of the compressor is stopped. As a result of repeated freezing and melting of the moisture, the protective coating applied to the outer surface of the casing undergoes stress, which may result in damaged portions such as cracks, tears, and holes. Subsequently, the moisture and the like contained in the outside air pass through these damaged portions and come into contact with the base metal of the casing which is made of iron or the like. This causes corrosion in the base metal.

An object of the present invention is to reduce the occurrence of corrosion of the casing in a compressor for a refrigerating machine.

A compressor according to a first aspect of the present invention includes a casing, a compression mechanism, and a motor. The casing is configured to cover an internal space. The internal space includes a first space and a second space larger than the first space. The casing includes a first casing part covering the first space and a second casing part covering the second space. The compression mechanism generates a high-pressure fluid by compressing a low-pressure fluid. The motor drives the compression mechanism. The first space and the second space are each a high-pressure space configured to contain the high-pressure fluid, or the second space is the high-pressure space and the first space is a low-pressure space configured to contain the low-pressure fluid. A metallic coating is formed on an outer surface of at least the first casing part.

According to this configuration, most of the casing covers the high-pressure space. Unlike the low-pressure fluid, the high-pressure fluid contained in the high-pressure space has a high temperature. Therefore, an outer surface of the casing is less likely to freeze, and consequently the occurrence of corrosion of the casing is reduced.

A compressor according to a second aspect of the present invention is the compressor according to the first aspect, wherein the metallic coating is also formed on an outer surface of the second casing part.

According to this configuration, the metallic coating is formed on the entire outer surface of the casing. Therefore, it becomes more difficult for moisture and the like to reach the base metal of the casing, further reducing the occurrence of corrosion.

A compressor according to a third aspect of the present invention is the compressor according to the first aspect or the second aspect, wherein the metallic coating is a metal-sprayed coating. The metal-sprayed coating is in contact with the casing.

According to this configuration, the metal-sprayed coating is formed on the casing. Therefore, portions of the casing that have complicated shapes are easily protected from moisture and the like.

A compressor according to a fourth aspect of the present invention is the compressor according to any one of the first aspect to the third aspect, wherein the casing is composed of a first metal. The metallic coating is composed of a second metal having an ionization tendency greater than that of the first metal.

According to this configuration, the metallic coating has an ionization tendency greater than that of the casing. In a case where moisture intrudes from holes or the like of the metallic coating and reaches the casing, the metallic coating tends to corrode prior to the casing. Therefore, the occurrence of corrosion of the casing is further reduced.

A compressor according to a fifth aspect of the present invention includes a casing, a compression mechanism, and a motor. The casing is configured to cover an internal space. The internal space includes a first space and a second space larger than the first space. The casing includes a first casing part covering the first space and a second casing part covering the second space. The compression mechanism generates a high-pressure fluid by compressing a low-pressure fluid. The motor drives the compression mechanism. Both the first space and the second space are high-pressure spaces configured to contain the high-pressure fluid. A resin coating is formed on an outer surface of the casing.

According to this configuration, substantially the entire region of the casing covers the high-pressure space. Unlike the low-pressure fluid, the high-pressure fluid contained in the high-pressure space has a high temperature. For this reason, the outer surface of the casing is less likely to freeze. Moreover, the resin coating protects the casing from moisture attached to the outer surface of the casing. For this reason, the occurrence of corrosion of the casing is reduced.

A compressor according to a sixth aspect of the present invention is the compressor according to any one of the first aspect to the fifth aspect, wherein the compression mechanism at least faces the first space. The motor is disposed in the second space.

According to this configuration, the motor with a fixed volume is disposed in the second space. Therefore, the area of low temperature on the outer surface of the casing can be made smaller than when the motor is disposed in the first space. For this reason, the outer surface is less likely to freeze.

A compressor according to a seventh aspect of the present invention is the compressor according to any one of the first aspect to the sixth aspect, wherein the casing is provided with a suction port configured to suction the low-pressure fluid. The compression mechanism includes a compression chamber that does not belong to either the first space or the second space. The suction port is configured to be communicated with the compression chamber.

According to this configuration, the low-temperature, low-pressure gas refrigerant to be suctioned into the compressor flows directly into the compression chamber without drifting in the internal space of the casing. Therefore, since the portions in the casing with which the low-temperature, low-pressure gas refrigerant comes into contact are extremely limited, freezing of the outer surface of the casing can be reduced effectively.

A compressor according to an eighth aspect of the present invention is the compressor according to any one of the first aspect to the seventh aspect, wherein the compression mechanism includes a fixed scroll and a movable scroll. The fixed scroll is fixed directly or indirectly to the casing. The movable scroll is configured to revolve with respect to the fixed scroll.

According to this configuration, the compressor is a scroll compressor. Thus, the output of the compressor in which the occurrence of corrosion of the casing is reduced can be increased.

A freezing and refrigeration container unit for marine transportation according to a ninth aspect of the present invention includes a container, a utilization heat exchanger, a heat source heat exchanger, a first refrigerant flow path, a second refrigerant flow path, a decompression device, and a compressor. The container is configured to contain articles. The utilization heat exchanger is disposed inside the container. The heat source heat exchanger is disposed outside the container. The first refrigerant flow path and the second refrigerant flow path are each configured to move a refrigerant between the utilization heat exchanger and the heat source heat exchanger. The decompression device is provided in the first refrigerant flow path. The compressor is provided in the second refrigerant flow path. The compressor is the one described in any one of the first aspect to the eighth aspect.

According to this configuration, the compressor mounted in the freezing and refrigeration container unit for marine transportation can reduce corrosion of the casing.

A manufacturing method according to a tenth aspect of the present invention is for manufacturing the compressor according to any one of the first aspect to the fourth aspect. The manufacturing method includes a step of preparing the casing, and a step of forming the metallic coating by thermally spraying the outer surface of at least the first casing part of the casing with a metal.

According to this method, the outer surface of at least the first casing part is thermally sprayed with a metal. Since the metallic coating is formed on the first casing part, a compressor less likely to corrode can be manufactured.

According to the compressor of the present invention, the occurrence of corrosion of the casing is reduced.

According to the freezing and refrigeration container unit for marine transportation of the present invention, with the compressor mounted therein, the occurrence of corrosion of the casing can be reduced.

According to the manufacturing method of the present invention, a compressor less likely to corrode can be manufactured.

DETAILED DESCRIPTION OF EMBODIMENT(S)

Embodiments of the compressor and the like according to the present invention are described hereinafter with reference to the drawings. Note that the specific configurations of the compressor and the like according to the present invention are not limited to the following embodiments and can be changed appropriately without departing from the gist of the present invention.

First Embodiment (1) Overall Configuration

Figure 1:
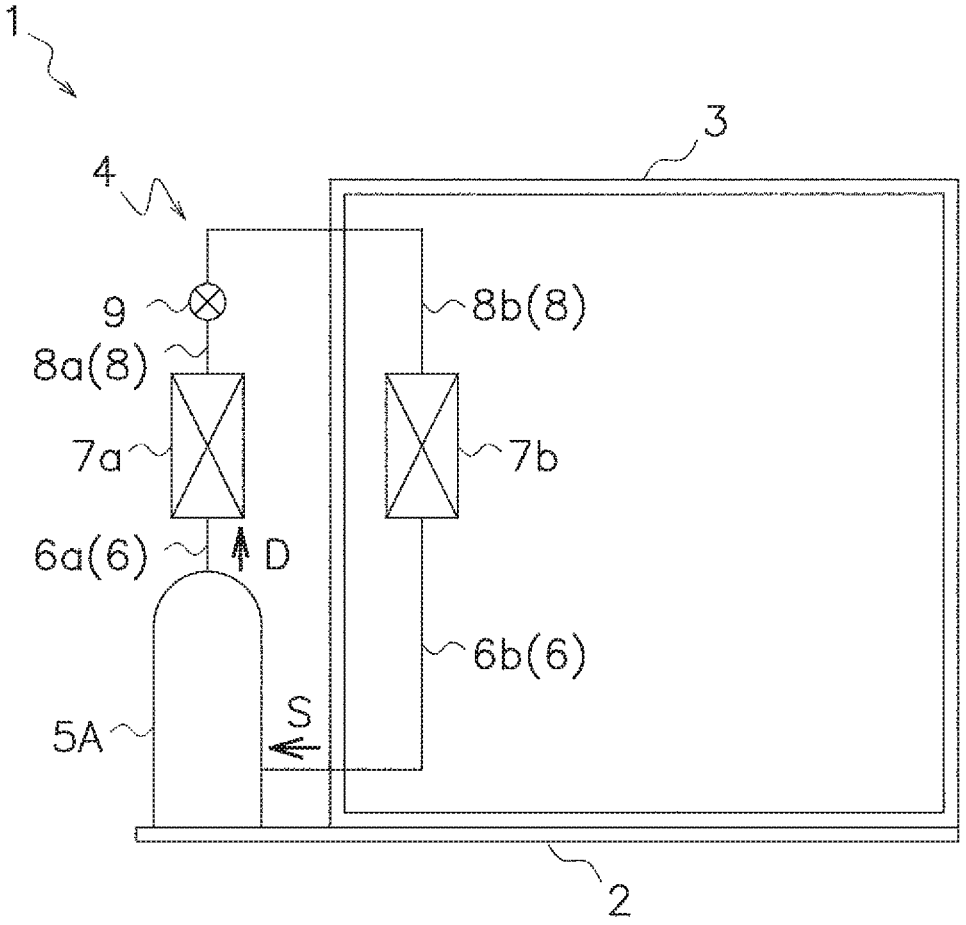
FIG. 1 is a schematic diagram showing a freezing and refrigeration container unit 1 for marine transportation according to a first embodiment of the present invention.

FIG. 1 shows the freezing and refrigeration container unit 1 for marine transportation having a compressor according to the first embodiment of the present invention. The freezing and refrigeration container unit 1 for marine transportation is placed on a ship and the like and used for transporting articles while freezing or refrigerating the articles.

The freezing and refrigeration container unit 1 for marine transportation includes a base plate 2, a container 3, and a refrigerant circuit 4. The container 3 is installed on the base plate 2 and configured to contain the articles. The refrigerant circuit 4 is configured to cool an internal space of the container 3.

(2) Detailed Configuration of Refrigerant Circuit 4

The refrigerant circuit 4 includes a heat source heat exchanger 7*a*, a utilization heat exchanger 7*b*, a first refrigerant flow path 8, a second refrigerant flow path 6, a decompression device 9, and the compressor 5A.

(2-1) Heat Source Heat Exchanger 7*a*

The heat source heat exchanger 7*a* is disposed outside the container 3. The heat source heat exchanger 7*a* exchanges heat between the outside air and a refrigerant by functioning as a heat radiator for the refrigerant, typically a refrigerant condenser.

(2-2) Utilization Heat Exchanger 7*b*

The utilization heat exchanger 7*b* is disposed inside the container 3. The utilization heat exchanger 7*b* exchanges heat between the air inside the container 3 and the refrigerant by functioning as a heat absorber for the refrigerant, typically a refrigerant evaporator.

(2-3) First Refrigerant Flow Path 8

The first refrigerant flow path 8 is a flow path configured to move the refrigerant between the utilization heat exchanger 7*b* and the heat source heat exchanger 7*a*. The first refrigerant flow path 8 includes a second pipeline 8*a* and a third pipeline 8*b*.

(2-4) Second Refrigerant Flow Path 6

The second refrigerant flow path 6 is a flow path configured separately from the first refrigerant flow path 8 so as to move the refrigerant between the utilization heat exchanger 7*b* and the heat source heat exchanger 7*a*. The second refrigerant flow path 6 includes a first pipeline 6*a* and a fourth pipeline 6*b*.

(2-5) Decompression Device 9

The decompression device 9 is a device for decompressing the refrigerant and is composed of, for example, an expansion valve. The decompression device 9 is provided in the first refrigerant flow path 8. Specifically, the decompression device 9 is provided between the second pipeline 8*a* and the third pipeline 8*b*. The decompression device 9 may be located on the outside or inside of the container 3.

(2-6) Compressor 5A

The compressor 5A is a device for compressing a low-pressure gas refrigerant, which is a fluid, to generate a high-pressure gas refrigerant, which is also a fluid. The compressor 5A functions as a cold source in the refrigerant circuit 4. The compressor 5A is provided in the second refrigerant flow path 6. Specifically, the compressor 5A is provided between the first pipeline 6*a* and the fourth pipeline 6*b*. The compressor 5A may be located on the inside of the container 3, but in most cases the compressor 5A is located on the outside of the container 3.

(3) Basic Operations

In typical basic operations of the refrigerant circuit 4 described hereinafter, the heat source heat exchanger 7*a* functions as a refrigerant condenser, and the utilization heat exchanger 7*b* functions as a refrigerant evaporator. However, depending on the type of the refrigerant used or other conditions, the basic operations of the refrigerant circuit 4 are not limited to these.

As shown in FIG. 1, the refrigerant circulates in the directions of the arrow D and the arrow S in the refrigerant circuit 4. The compressor 5A discharges the high-pressure gas refrigerant in the direction of the arrow D. After proceeding through the first pipeline 6*a*, the high-pressure gas refrigerant reaches the heat source heat exchanger 7*a*, where the high-pressure gas refrigerant is condensed to a high-pressure liquid refrigerant. In this condensation process, the refrigerant dissipates heat to the outside air. After proceeding through the second pipeline 8*a*, the high-pressure liquid refrigerant reaches the decompression device 9, where the high-pressure liquid refrigerant is decompressed into a low-pressure gas-liquid two-phase refrigerant. After proceeding through the third pipeline 8*b*, the low-pressure gas-liquid two-phase refrigerant reaches the utilization heat exchanger 7*b*, where the low-pressure gas-liquid two-phase refrigerant is evaporated to a low-pressure gas refrigerant. In this evaporation process, the refrigerant provides cold heat to the air inside the container 3, thereby freezing or refrigerating the articles contained in the container 3. After proceeding through the fourth pipeline 6*b*, the low-pressure gas refrigerant is suctioned into the compressor 5A along the arrow S.

(4) Detailed Configuration of Compressor 5A

Figure 2:
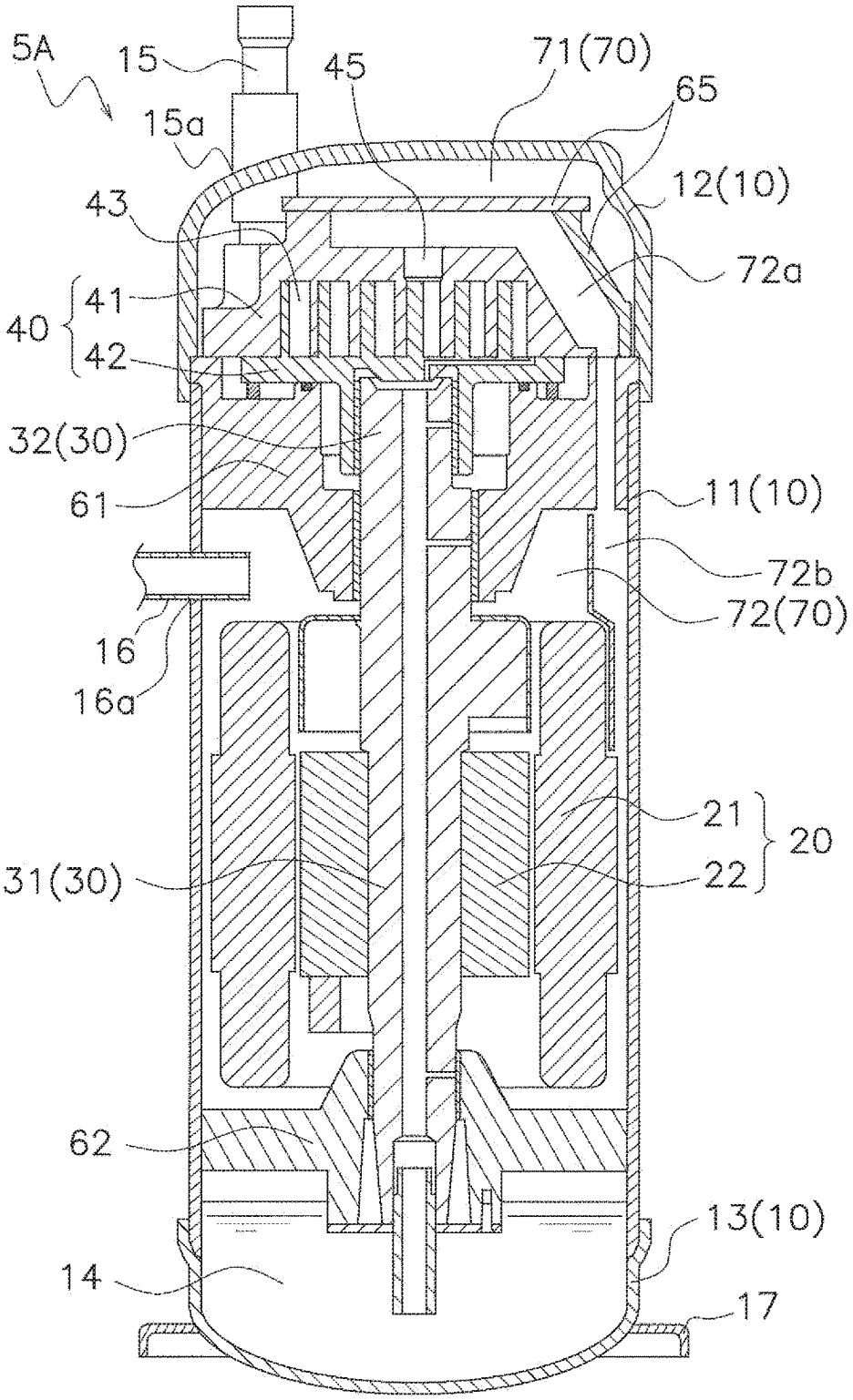
FIG. 2 is a cross-sectional view of a compressor 5A according to the first embodiment of the present invention.

FIG. 2 is a cross-sectional view of the compressor 5A according to the first embodiment of the present invention. The compressor 5A is a so-called high-pressure dome type scroll compressor. The compressor 5A includes the casing 10, a motor 20, a crankshaft 30, a compression mechanism 40, an upper bearing holding member 61, and a lower bearing holding member 62.

(4-1) Casing 10

The casing 10 is configured to contain, in an internal space 70 thereof, the motor 20, the crankshaft 30, the compression mechanism 40, the upper bearing holding member 61, and the lower bearing holding member 62. The casing 10 includes a casing body part 11, a casing upper part 12, and a casing lower part 13, which are welded together airtight. The casing 10 is strong enough to withstand the pressure of the refrigerant filling the internal space 70.

The casing upper part 12 is provided with a suction port 15*a*, and a suction pipe 15 for suctioning the refrigerant is inserted into the suction port 15*a* and fixed airtight thereto by welding. The casing body part 11 is provided with a discharge port 16*a*, and a discharge pipe 16 for discharging the refrigerant is inserted into the discharge port 16*a* and fixed airtight thereto by welding. An oil reservoir 14 for storing a refrigeration oil is provided in the lower part of the internal space 70 of the casing 10. A support part 17 for supporting the casing 10 upright is welded to the casing lower part 13.

The internal space 70 of the casing is divided into a first space 71 and a second space 72 by a partition member 65 and other parts. The first space 71 is a low-pressure space configured to be filled with the low-pressure gas refrigerant. The second space 72 is a high-pressure space configured to be filled with the high-pressure gas refrigerant. The second space 72 has a volume greater than that of the first space 71.

(4-2) Motor 20

The motor 20 receives a supply of electricity to generate power. The motor 20 has a stator 21 and a rotor 22. The stator 21 is fixed to the casing 10 and has a coil, not shown, for generating a magnetic field. The rotor 22 is configured to be rotatable with respect to the stator 21 and has a permanent magnet, not shown, for magnetically interacting with the coil. The motor 20 is disposed in the second space 72.

The temperature of the high-pressure gas refrigerant filling the second space 72 is high. Therefore, placing the motor 20, which is a heat-generating component, in the second space 72 has been avoided in the past. However, motors available in the market recently have been improved, among which some do not generate as much heat as before. The inventor of the present invention has discovered that it is now possible to place the motor 20 in the second space 72.

(4-3) Crankshaft 30

The crankshaft 30 transmits the power generated by the motor 20. The crankshaft 30 includes a concentric part 31 and an eccentric part 32. The concentric part 31 has a shape concentric with the rotation axis of the rotor 22 and is fixed together with the rotor 22. The eccentric part 32 is eccentric with respect to the rotation axis of the rotor 22. When the concentric part 31 rotates together with the rotor 22, the eccentric part 32 moves in a circle.

(4-4) Compression Mechanism 40

The compression mechanism 40 is a mechanism for compressing the low-pressure gas refrigerant to generate the high-pressure gas refrigerant. The compression mechanism 40 is driven by the power transmitted by the crankshaft 30.

The compression mechanism 40 includes a fixed scroll 41 and a movable scroll 42. The fixed scroll 41 is fixed directly or indirectly to the casing 10. For example, the fixed scroll 41 is fixed indirectly to the casing body part 11 via the upper bearing holding member 61 described hereinafter. The movable scroll 42 is configured to be able to revolve with respect to the fixed scroll 41. The eccentric part 32 of the crankshaft 30 is fitted to the movable scroll 42 together with a bearing. As the eccentric part 32 moves in a circle, the movable scroll 42 revolves with power.

The fixed scroll 41 and the movable scroll 42 each have an end plate and a spiral wrap standing upright on the end plate. Several spaces surrounded by the end plates and the wraps of the fixed scroll 41 and the movable scroll 42 are compression chambers 43. When the movable scroll 42 revolves, one compression chamber 43 gradually reduces the volume thereof while moving from the peripheral portion to the central portion. In this process, the low-pressure gas refrigerant contained in the compression chamber 43 is compressed into the high-pressure gas refrigerant. The high-pressure gas refrigerant is discharged from a discharge port 45 provided in the fixed scroll 41 to a chamber 72*a* located outside the compression mechanism 40, and then passes through a high-pressure passage 72*b*. The chamber 72*a* and the high-pressure passage 72*b* each constitute a part of the second space 72. The high-pressure gas refrigerant in the second space 72 is eventually discharged from the discharge pipe 16 to the outside of the compressor 5A.

The compression mechanism 40 as a whole may function to divide the first space 71 and the second space 72 from each other in cooperation with the partition member 65.

(4-5) Upper Bearing Holding Member 61

The upper bearing holding member 61 holds a bearing. The upper bearing holding member 61 rotatably supports the upper side of the concentric part 31 of the crankshaft 30 via the bearing. The upper bearing holding member 61 is fixed to an upper part of the casing body part 11. The upper bearing holding member 61 may function to divide the first space 71 and the second space 72 from each other in cooperation with the partition member 65.

(4-6) Lower Bearing Holding Member 62

The lower bearing holding member 62 holds a bearing. The lower bearing holding member 62 rotatably supports the lower side of the concentric part 31 of the crankshaft 30 via the bearing. The lower bearing holding member 62 is fixed to a lower part of the casing body part 11.

(5) Detailed Structure of Casing 10

Figure 3:
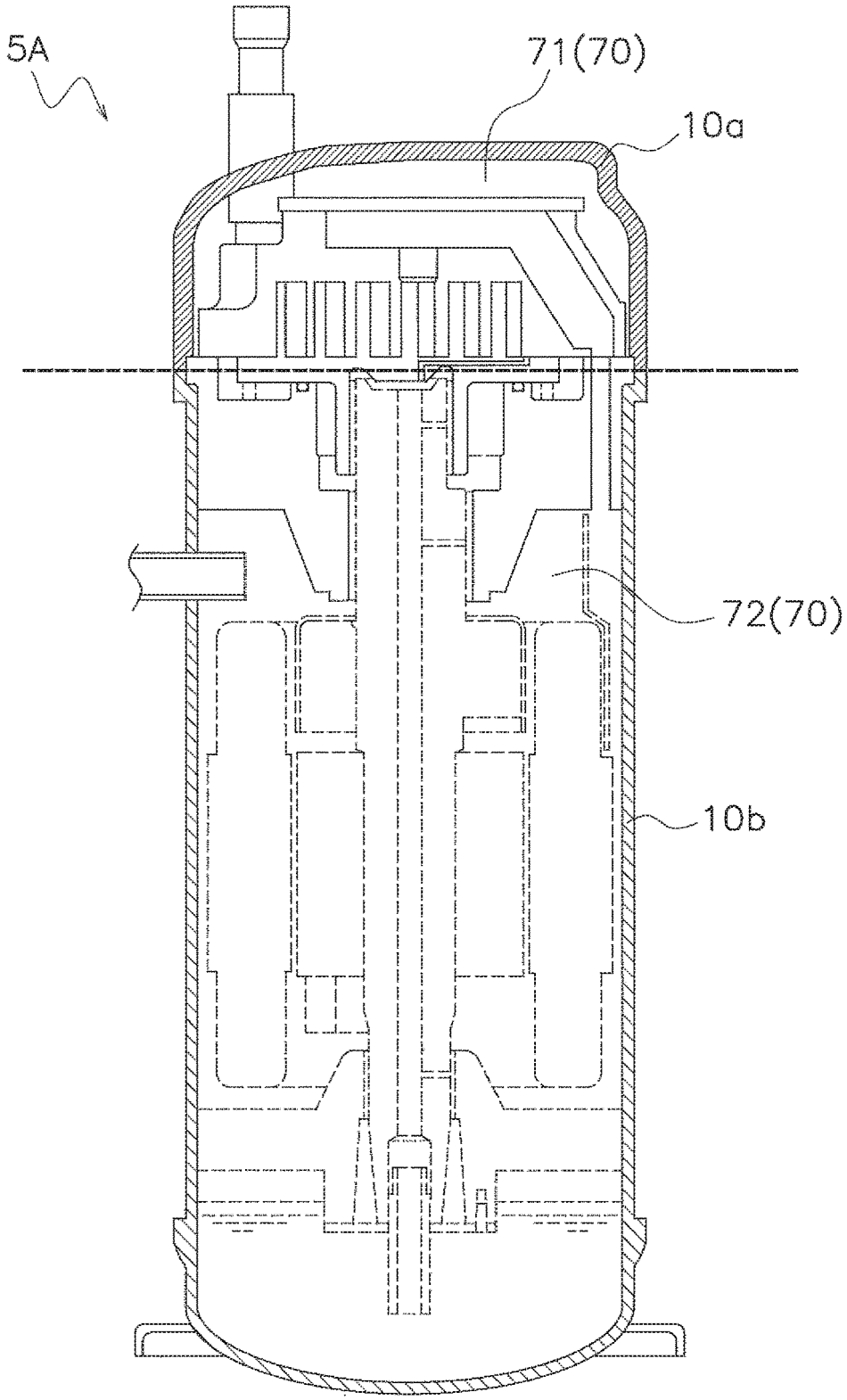
FIG. 3 is a cross-sectional view of the compressor 5A according to the first embodiment of the present invention.

FIG. 3 is a diagram for explaining the high-pressure dome type scroll structure of the compressor 5A. From a functional viewpoint, the casing 10, which is an assembly of the casing body part 11, the casing upper part 12, and the casing lower part 13, includes two regions, a first casing part 10*a* and a second casing part 10*b*. The first casing part 10*a* is a region covering the first space 71. The second casing part 10*b* is a region covering the second space 72. The second casing part 10*b* makes up a dominant proportion to the surface area of the casing 10.

Figure 4:
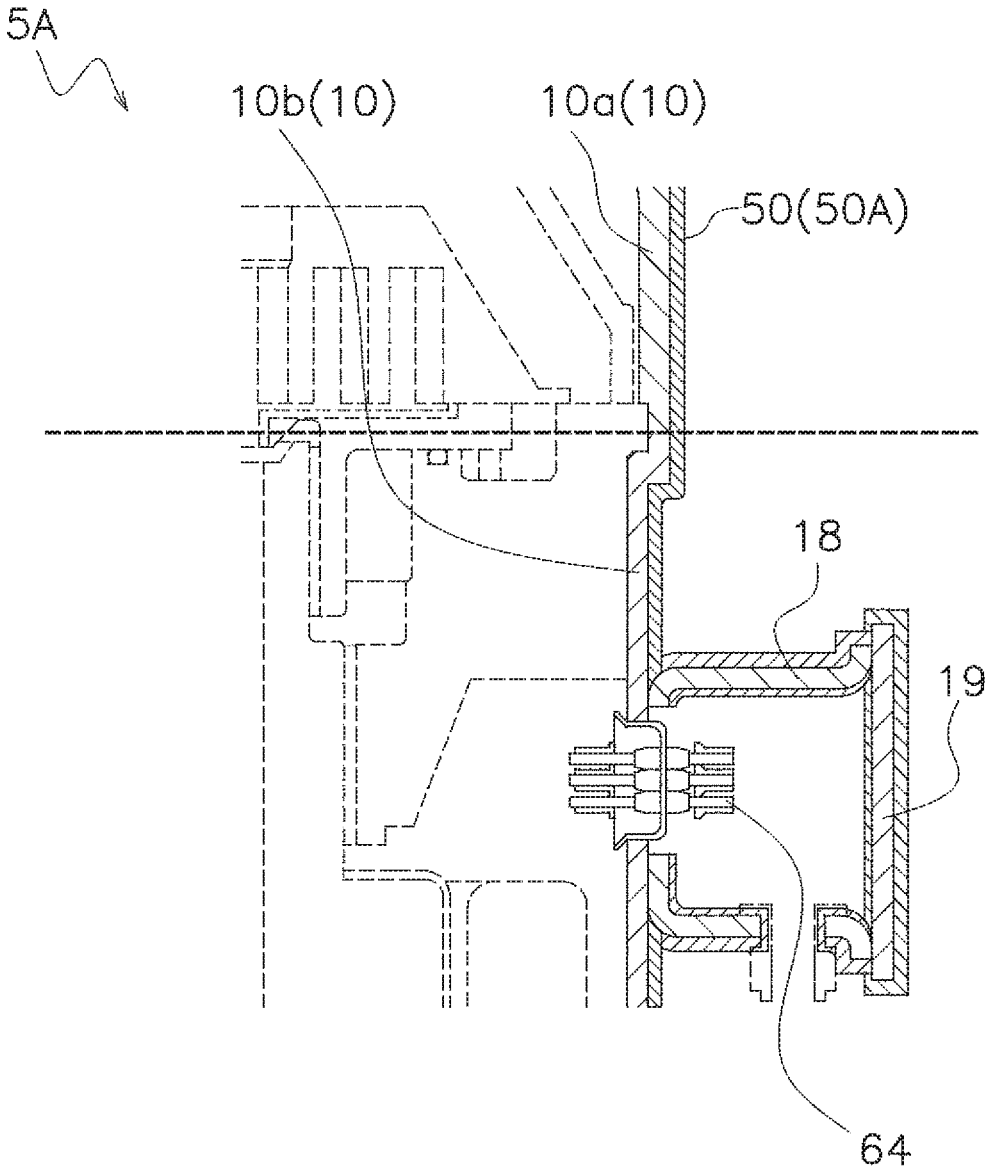
FIG. 4 is a schematic diagram of a casing 10 of the compressor 5A according to the first embodiment of the present invention.

FIG. 4 is another cross-sectional view of the compressor 5A, viewed along a line different from that of the sectional view shown in FIG. 2. A terminal 64 for supplying electricity to the motor 20 is buried in the casing 10. A terminal guard 18 is installed in the casing 10. A terminal cover 19 is attached to the terminal guard 18. The terminal guard 18 and the terminal cover 19 protect the terminal 64 from the external environment by surrounding the terminal 64.

(6) Protective Coating 50 in Casing 10 Etc.

For the purpose of protecting the compressor 5A, a protective coating 50 is provided on at least part of the casing 10, the suction pipe 15, the discharge pipe 16, the support part 17, the terminal guard 18, the terminal cover 19, and other parts (collectively referred to as "base metal," hereinafter). FIG. 4 shows the protective coating 50 in an exaggerated manner. The protective coating 50 is formed at least on the first casing part 10*a*. In the configuration shown in FIG. 4, the protective coating 50 is formed on both the first casing part 10*a* and the second casing part 10*b*. The protective coating 50 may be formed on the terminal guard 18 and the terminal cover 19 as well. The protective coating 50 is formed in such a manner as to come into contact with these parts of the base metal. The protective coating 50 is provided in order to reduce corrosion of the base metal. The protective coating 50 reduces adhesion of moisture and the like to the base metal, which is attributable to the marine environment.

(6-1) Materials

While the base metal is composed of a first metal, the protective coating 50 is a metallic coating 50A composed of, for example, a second metal different from the first metal. It is preferred that the second metal be a so-called less-noble metal having an ionization tendency greater than that of the first metal. The first metal is, for example, iron. The second metal is, for example, aluminum, magnesium, zinc, or an alloy containing any of these metals. Moreover, the metallic coating 50A used as the protective coating 50 may be made of a material obtained by mixing ceramics with the second metal.

(6-2) Durability

Since the low-temperature, low-pressure gas refrigerant comes into contact with the first casing part 10*a*, moisture attached to the first casing part 10*a* tends to freeze. As the compressor 5A is repeatedly operated and stopped, freezing and melting of the moisture occur alternately in the first casing part 10*a*, and the metallic coating 50A is liable to be damaged by stress caused by such freezing and melting. For this reason, the possibility of corrosion of the base metal at the first casing part 10*a* is relatively high.

Since the high-temperature, high-pressure gas refrigerant comes into contact with the second casing part 10*b*, moisture attached to the second casing part 10*b* is less likely to freeze. Thus, the possibility of corrosion of the base metal at the second casing part 10*b* is relatively low.

(6-3) Formation Methods

The metallic coating 50A can be formed by various methods such as thermal spraying, vacuum deposition, sputtering, plating, and pasting of rolled metal foil. In a case where a metal-sprayed coating formed by thermal spraying is adopted as the metallic coating 50A, the average thickness of the metallic coating 50A can easily be changed depending on the part of the base metal. The metal-sprayed coating, the average thickness of which is controlled in accordance with the likeliness of corrosion of the abovementioned part of the base plate, has a structure and ability to reduce corrosion of this part of the base metal over a long period of time. In addition, although the metal-sprayed coating sometimes has the properties of a porous material, the average thickness of the metal-sprayed coating can be controlled and made thick to the extent that performance of the protective coating is not impaired by such properties. Furthermore, since the position, angle, and moving speed of the spray head of a thermal sprayer can be adjusted relatively freely, the metal-sprayed coating can easily be formed even on portions on the base metal that have complicated shapes.

(6-4) Method for Manufacturing Compressor 5A

An example of the method for manufacturing the compressor 5A having a metal-sprayed coating as the metallic coating 50A is now described hereinafter.

(6-4-1) Preparation

The compressor 5A, which does not yet have the protective coating 50 formed thereon, is prepared. Basic assembly of the compressor 5A is completed. Various parts and the refrigeration oil are contained in the casing 10. An anti-rust oil is applied to a surface of the base metal such as the casing 10, in order to prevent rust from forming during the storage life.

(64-2) Degreasing

For the purpose of achieving stronger adhesion of the metallic coating 50A to be formed to the base metal, a degreasing process for removing the anti-rust oil from the base metal is performed.

(64-3) Masking

Masking is performed on portions where the metallic coating 50A is preferably not formed. The portions to be masked include, for example, the terminal 64, bolt holes formed in the base metal, and the like.

(6-4-4) Roughening

For the purpose of achieving stronger adhesion of the metallic coating 50A, a blasting process is performed to make the surface of the base metal rough. As a result of the blasting process, oxide films, scales, and other deposits on the surface of the base metal are removed. It is preferred that the shape of the surface of the base metal after the blasting process be sharp. For this reason, as a shot blasting material used in the blasting process, sharp particles are preferred over spherical particles. It is preferred that the shot blasting material be alumina having hardness.

A process for applying a rough surface forming agent to the surface of the base metal may be performed in place of the blasting process.

(64-5) Heating

The base metal is heated in order to evaporate and remove the moisture and the like on the surface of the base metal. As a result, adhesion of the metallic coating 50A to the base metal is further improved. The temperature of the surface of the base metal preferably does not exceed, for example, 150° C. Accordingly, damage to various parts and deterioration of the refrigeration oil can be restrained.

(64-6) Thermal Spraying

A thermal spraying process for spraying the surface of the base metal with a flowable material is performed. It is preferred that the thermal spraying process be performed within four hours after the blasting process. Otherwise, the adhesion between the metallic coating 50A and the base metal drops due to a decrease in surface activity, adhesion of moisture, and the like.

As described above, a mixture of the second metal and ceramics may be used as the flowable material instead of using the second metal. Alternatively, a ceramics-sprayed coating may be formed on the metal-sprayed coating composed of the second metal, and then a plurality of layers of protective coating 50 may be formed thereon. Depending on the type of the flowable material, an appropriate thermal spraying method is selected from among flame spraying, arc spraying, plasma spraying, and the like.

The thickness of the metal-sprayed coating to be formed is controlled by adjusting the spraying time, the angle and moving speed of the spray head of the thermal sprayer, and other conditions. In a case where an edge is present in the base metal, the thickness of the metal-sprayed coating at the portion of the edge tends to be smaller than an intended thickness. For this reason, it is preferred that the base metal be chamfered prior to the execution of the thermal spraying process.

(6-4-7) Sealing

In order to reliably reduce corrosion of the base metal, a sealing process for closing holes 91 present in the formed metal-sprayed coating is performed. In the sealing process, a sealing agent 93 is applied to the rental-sprayed coating 50A with a brush. Alternatively, the sealing agent 93 may be sprayed onto the metal-sprayed coating 50A. Alternatively, the base metal having the metal-sprayed coating 50A may be immersed in a tank of sealing agent 93.

Examples of the sealing agent 93 include, for example, silicon resin, acrylic resin, epoxy resin, urethane resin, and fluorine resin. The sealing agent 93 may contain metallic flake 92. In this case, a labyrinth seal 90 is formed in the holes 91 of the metal-sprayed coating 50A, reducing the moisture permeability of the metal-sprayed coating 50A.

The sealing process is performed within twelve hours at most, or preferably five hours, after the thermal spraying process. Otherwise, moisture adhesion and the like may occur, preventing the sealing agent 93 from penetrating easily. As with the thermal spraying process, it is preferred that the base metal be heated in advance in performing the sealing. process.

(64-8) Painting

In order to further improve anticorrosion performance or to improve the appearance of the compressor 5A, painting may be performed.

(7) Features (7-1)

Most of the casing 10 covers the second space 72. Unlike the low-pressure fluid, the high-pressure fluid contained in the second space 72 has a high temperature. Therefore, the outer surface of the casing 10 is less likely to freeze, and consequently the occurrence of corrosion of the outer surface of the casing 10 is reduced.

(7-2)

The metallic coating 50A is formed on the entire outer surface of the casing 10.

Therefore, it becomes more difficult for moisture and the like to reach the casing 10, further reducing the occurrence of corrosion.

(7-3)

A metal-sprayed coating is formed on the casing 10. Therefore, portions of the casing that have complicated shapes are easily protected from moisture and the like.

(7-4)

The metallic coating 50A has an ionization tendency greater than that of the casing 10. In a case where moisture intrudes from holes or the like of the metallic coating 50A and reaches the casing 10, the metallic coating 50A tends to corrode prior to the casing 10. In other words, the metallic coating 50A has a function of sacrificial protection. Therefore, the occurrence of corrosion of the casing 10 is further reduced.

(7-5)

The motor 20 with a fixed volume is disposed in the second space 72. Therefore, the area of low temperature on the outer surface of the casing 10 can be made smaller than when the motor 20 is disposed in the first space 71. For this reason, the outer surface of the casing is less likely to freeze.

(7-6)

The compressor 5A is a scroll compressor. Thus, the output of the compressor in which the occurrence of corrosion of the casing 10 is reduced can be increased.

(7-7)

The compressor 5A mounted in the freezing and refrigeration container unit 1 for marine transportation can reduce corrosion of the casing 10.

(7-8)

The outer surface of at least the first casing part 10*a* is thermally sprayed with a metal. Since the metallic coating 50A is formed on the first casing part 10*a*, the compressor 5A less likely to corrode can be manufactured.

Second Embodiment (1) Structure

Figure 5:
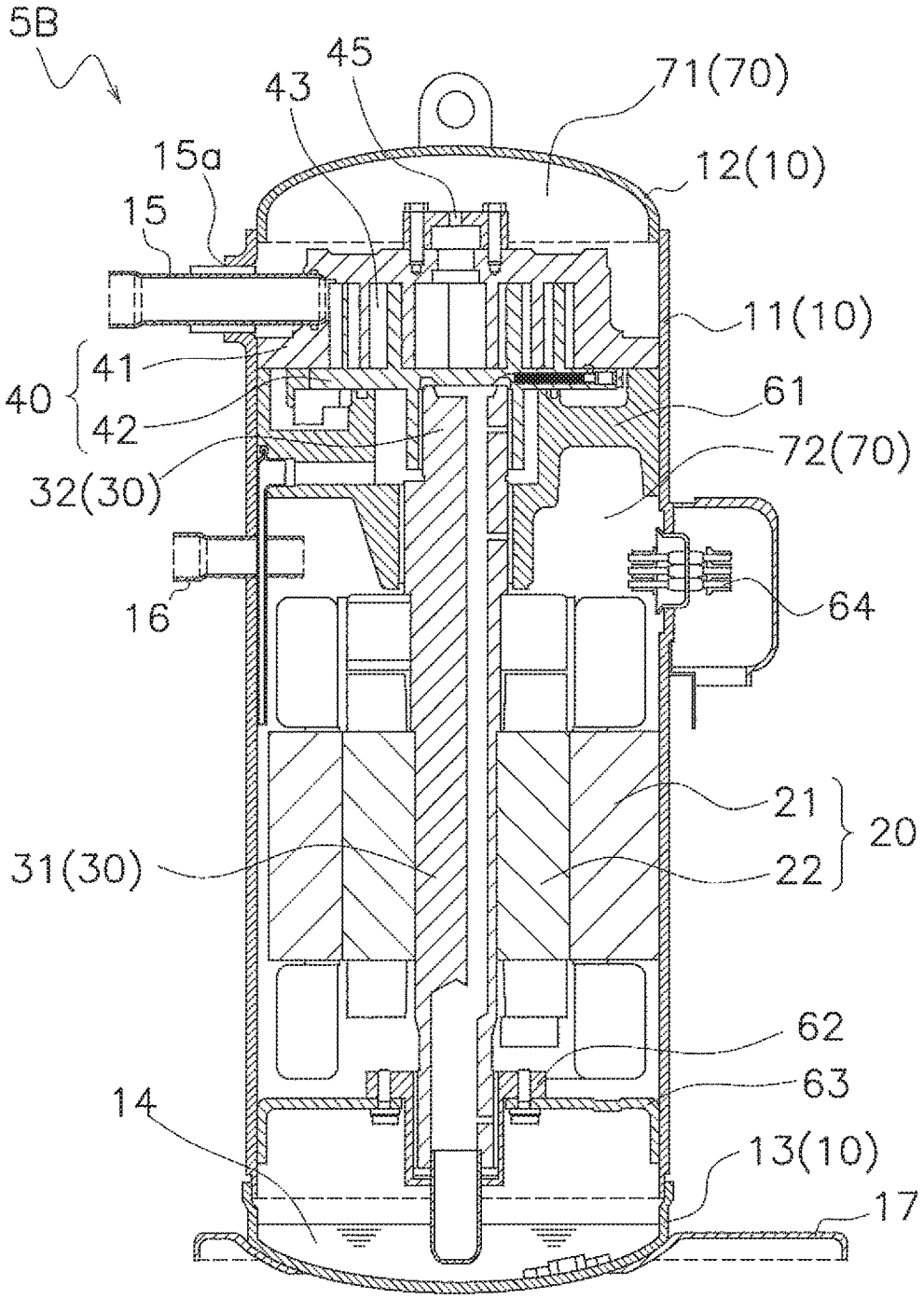
FIG. 5 is a cross-sectional view of a compressor 5B according to a second embodiment of the present invention.

FIG. 5 is a cross-sectional view of a compressor 5B according to the second embodiment of the present invention. The compressor 5B is a so-called full high-pressure dome type scroll compressor. As shown in FIG. 5, same reference numerals are used on the same parts as those of the compressor 5A according to the first embodiment. In place of the compressor 5A according to the first embodiment, the compressor 5B according to the second embodiment can be mounted in the freezing and refrigeration container unit 1 for marine transportation shown in FIG. 1.

The internal space 70 of the casing is divided into the first space 71 and the second space 72 by the upper bearing holding member 61 or other parts. However, the upper bearing holding member 61 or the other parts do not hermetically isolate the first space 71 and the second space 72 from each other; thus, the first space 71 and the second space 72 are communicated with each other. The volume of the second space 72 is greater than that of the first space 71. The motor 20 is disposed in the second space 72.

The low-pressure gas refrigerant to be suctioned from the suction pipe 15 proceeds directly into the compression chamber 43 without being released into the internal space 70 of the casing 10. The high-pressure gas refrigerant to be discharged from the discharge port 45 of the compression mechanism 40 is released into the first space 71. Since the first space 71 is communicated with the second space 72, the first space 71 and the second space 72 are each a high-pressure space configured to be filled with the high-pressure gas refrigerant.

Figure 6:
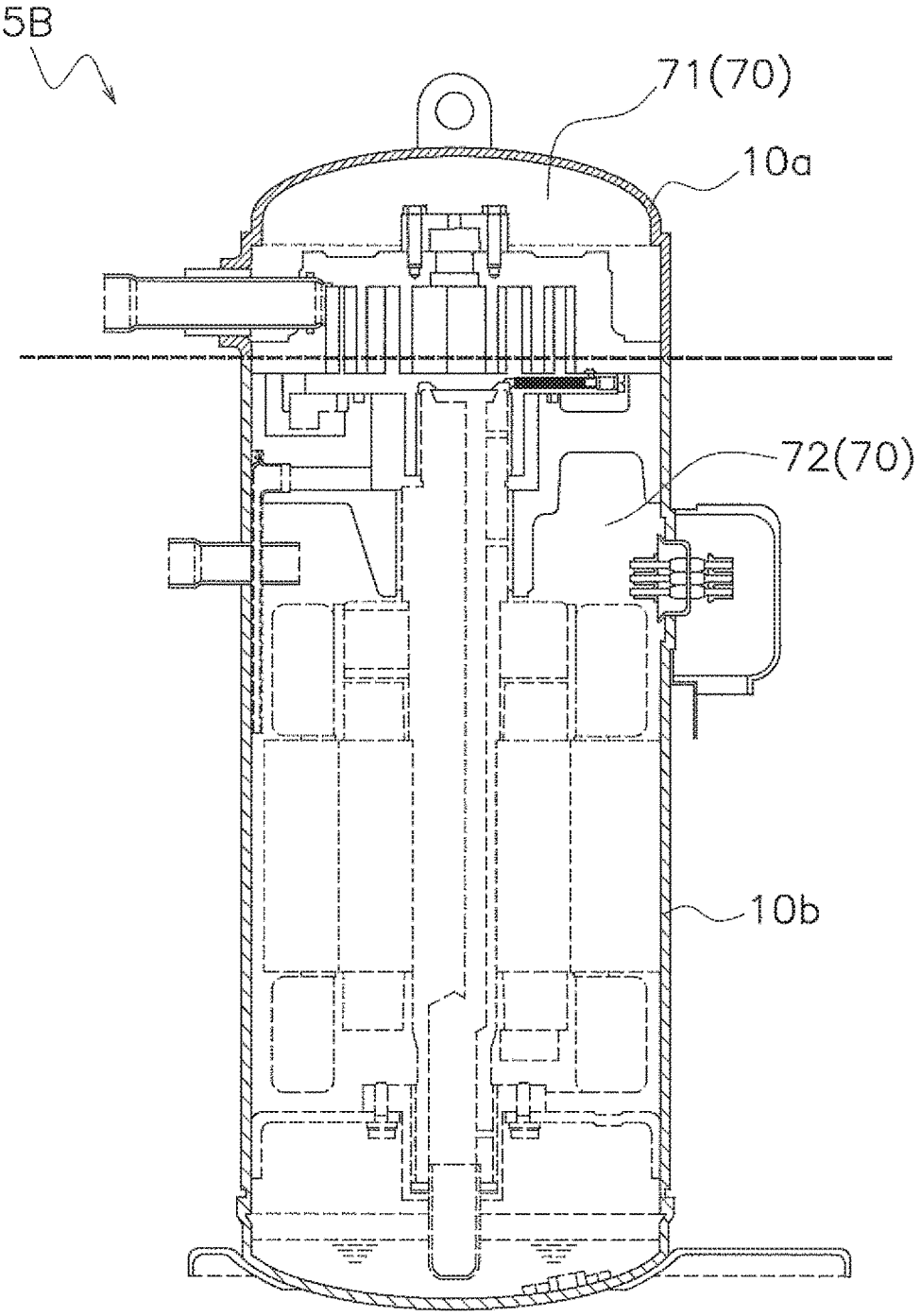
FIG. 6 is a cross-sectional view of the compressor 5B according to the second embodiment of the present invention.

FIG. 6 is a diagram for explaining the full high-pressure dome type scroll structure of the compressor 5B. As with the compressor 5A according to the first embodiment, the casing includes two regions, the first casing part 10*a* and the second casing part 10*b*. However, since the high-temperature, high-pressure gas refrigerant comes into contact with both the first casing part 10*a* and the second casing part 10*b*, moisture attached to the first casing part 10*a* and the second casing part 10*b* is less likely to freeze. Therefore, in the casing 10 of the compressor 5B, the possibility of corrosion of the base metal is relatively low.

Figure 7:
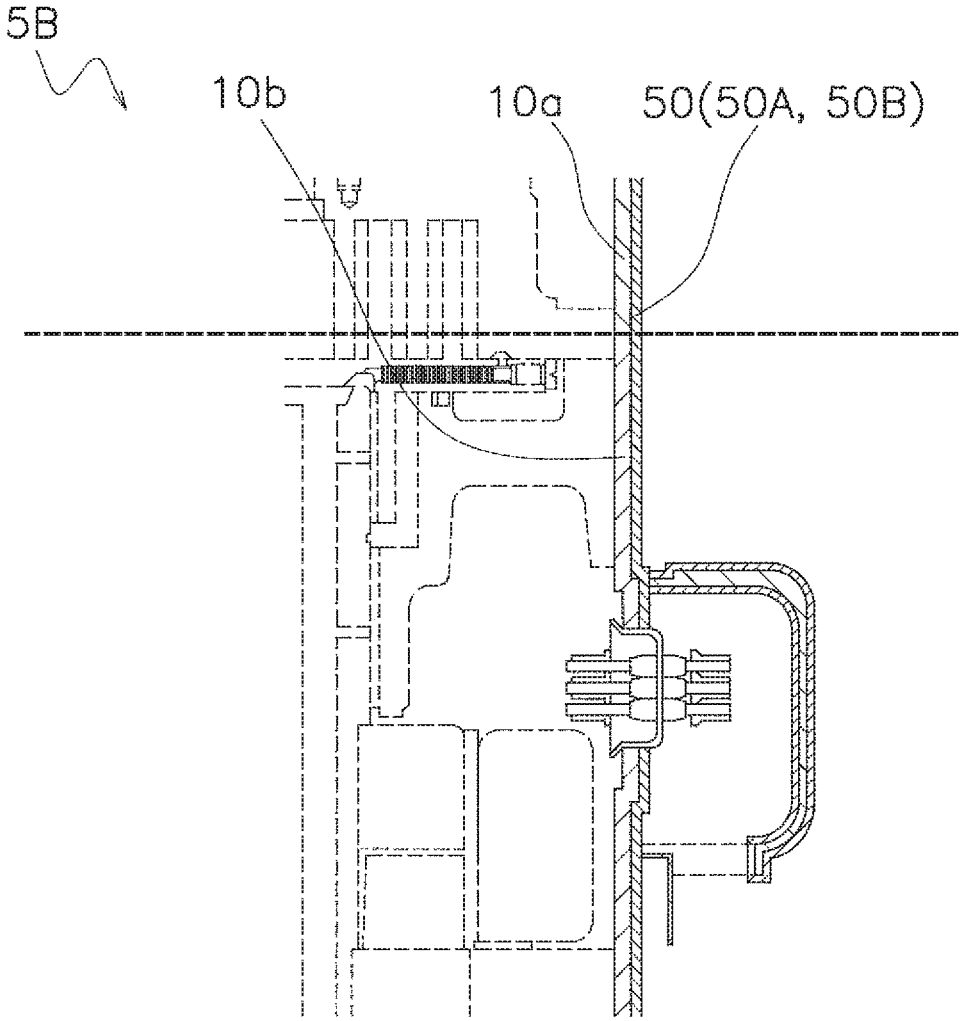
FIG. 7 is a schematic diagram of a casing 10 of the compressor 5B according to the second embodiment of the present invention.

FIG. 7 is a schematic diagram showing in an exaggerated manner the protective coating 50 provided on the base metal such as the casing 10. As in the first embodiment, the protective coating 50 may be the metallic coating 50A. Alternatively, the protective coating 50 may be a resin coating 50B. The resin coating 50B can be formed by applying a resin paint to the base metal. Since moisture is less likely to freeze on the surface of the casing 10 of the full high-pressure dome type compressor 5B as described above, the risk of damage to the protective coating 50 is low. Consequently, cost reduction can be achieved by allowing the employment of the resin coating 50B having a greater moisture permeability than the metallic coating 50A.

(2) Features (2-1)

Substantially the entire region of the casing 10 covers the high-pressure space. Unlike the low-pressure fluid, the high-pressure fluid contained in the high-pressure space has a high temperature. For this reason, the outer surface of the casing 10 is less likely to freeze. Moreover, the metallic coating 50A or the resin coating 50B protects the casing from moisture attached to the outer surface of the casing 10. As a result, the occurrence of corrosion of the outer surface of the casing 10 is reduced.

(2-2)

The low-temperature, low-pressure gas refrigerant to be suctioned into the compressor 5A flows directly into the compression chamber 43 without drifting in the internal space 70 of the casing 10. Therefore, since the portions in the casing 10 with which the low-temperature, low-pressure gas refrigerant comes into contact are extremely limited, freezing of the outer surface of the casing 10 can be reduced effectively.

What is claimed is:

1. A compressor, comprising:

a casing that is configured to cover an internal space, the internal space including a first space and a second space larger than the first space, the casing having a first casing part covering the first space, and the casing having a second casing part covering the second space;

a compression mechanism that generates a high-pressure fluid by compressing a low-pressure fluid; and a motor that drives the compression mechanism, the first space and the second space are each a high-pressure space configured to contain the high-pressure fluid, or the second space is a high-pressure space configured to contain the high-pressure fluid and the first space is a low-pressure space configured to contain the low-pressure fluid, and a metallic coating being formed on an outer surface of at least the first casing part; and a labyrinth seal by a sealing agent containing metal flake is formed in holes of the metallic coating.

2. The compressor according to claim 1, wherein the metallic coating is also formed on an outer surface of the second casing part.

3. The compressor according to claim 2, wherein the metallic coating is a metal-sprayed coating that is in contact with the casing.

4. The compressor according to claim 2, wherein the casing includes a first metal, and the metallic coating includes a second metal having an ionization tendency greater than that of the first metal.

5. The compressor according to claim 1, wherein the metallic coating is a metal-sprayed coating that is in contact with the casing.

6. The compressor according to claim 5, wherein the casing includes a first metal, and the metallic coating includes a second metal having an ionization tendency greater than that of the first metal.

7. The compressor according to claim 1, wherein the casing includes a first metal, and the metallic coating includes a second metal having an ionization tendency greater than that of the first metal.

8. The compressor according to claim 1, wherein the compression mechanism at least faces the first space, and the motor is disposed in the second space.

9. The compressor according to claim 1, wherein the casing is provided with a suction port configured to suction the low-pressure fluid, the compression mechanism includes a compression chamber that is not part of either the first space or the second space, and the suction port is configured to be communicated with the compression chamber.

10. The compressor according to claim 1, wherein the compression mechanism includes a fixed scroll fixed directly or indirectly to the casing, and a movable scroll revolvable with respect to the fixed scroll.

11. A freezing and refrigeration container unit including the compressor according to claim 1, the freezing and refrigeration container being configured for marine transportation, the freezing and refrigeration container unit further comprising:

a container configured to contain articles;

a utilization heat exchanger disposed inside the container;

a heat source heat exchanger disposed outside the container;

a first refrigerant flow path and a second refrigerant flow path that are each configured to move a refrigerant between the utilization heat exchanger and the heat source heat exchanger, the compressor being provided in the second refrigerant flow path; and a decompression device provided in the first refrigerant flow path.

12. A method for manufacturing the compressor according to claim 1, the method comprising:

preparing the casing; and forming the metallic coating by thermally spraying the outer surface of at least the first casing part of the casing with a metal.

13. A freezing and refrigeration container unit including the compressor according to claim 1, the freezing and refrigeration container being configured for marine transportation, the freezing and refrigeration container unit further comprising:

a container configured to contain articles;

a utilization heat exchanger disposed inside the container;

a heat source heat exchanger disposed outside the container;

a first refrigerant flow path and a second refrigerant flow path that are each configured to move a refrigerant between the utilization heat exchanger and the heat source heat exchanger, the compressor being provided in the second refrigerant flow path; and a decompression device provided in the first refrigerant flow path.

* * * * *